US006196198B1

(12) United States Patent
Kampichler

(10) Patent No.: US 6,196,198 B1
(45) Date of Patent: Mar. 6, 2001

(54) REGULATING DEVICE AND METHOD FOR MANUFACTURING SAME

(75) Inventor: Guenter Kampichler, Ruhstorf (DE)

(73) Assignee: Motorefabrik Hatz GmbH & Co. KG, Ruhstorf (DE)

( * ) Notice: Subject to any disclaimer, the term of this patent is extended or adjusted under 35 U.S.C. 154(b) by 0 days.

(21) Appl. No.: 09/498,113

(22) Filed: Feb. 4, 2000

Related U.S. Application Data

(63) Continuation of application No. PCT/EP98/03680, filed on Jun. 18, 1998.

(30) Foreign Application Priority Data

Aug. 7, 1997 (DE) ..... 197 34 196

(51) Int. Cl.[7] ..... F02M 39/00
(52) U.S. Cl. ..... 123/495; 417/499
(58) Field of Search ..... 123/495, 500, 123/501; 417/490, 499

(56) References Cited

U.S. PATENT DOCUMENTS

| | | | | |
|---|---|---|---|---|
| 3,624,823 | * | 11/1971 | Staudt | 417/499 |
| 4,430,977 | | 2/1984 | Shimada . | |
| 4,625,700 | * | 12/1986 | Elsbett et al. | 123/500 |
| 4,630,586 | * | 12/1986 | Guntert et al. | 123/500 |
| 4,737,086 | * | 4/1988 | Yamaguchi et al. | 123/500 |
| 4,754,737 | | 7/1988 | Ishida et al. . | |
| 4,793,316 | | 12/1988 | Seiler et al. . | |
| 4,840,161 | * | 6/1989 | Eckell et al. | 123/500 |
| 5,097,812 | * | 3/1992 | Augustin | 123/500 |

FOREIGN PATENT DOCUMENTS

| | | |
|---|---|---|
| 35 44 051 | 6/1987 | (DE) . |
| 41 34 592 | 4/1993 | (DE) . |
| 60 27776 | 2/1985 | (JP) . |
| 60 132064 | 7/1985 | (JP) . |
| 60 166751 | 8/1995 | (JP) . |

* cited by examiner

*Primary Examiner*—Thomas N. Moulis
(74) *Attorney, Agent, or Firm*—Helfgott & Karas, P.C.

(57) ABSTRACT

A regulating device (1) for controlling the delivery flow in a motor-fuel injection pump is provided with a pump cylinder (2), a pump piston (3) with longitudinal groove and control edge, a piston foot (4) and an adjusting sleeve (5), the piston foot (4) being accommodated in the adjusting sleeve (5) in such a way that it is freely movable in axial direction. The adjusting sleeve (5) has an elongated thin-walled tubular profile (6), a regulating turning-lever plate (7) joined to the tubular profile (6), and a regulating turning lever (8).

11 Claims, 5 Drawing Sheets

REGULATING DEVICE AND METHOD FOR MANUFACTURING SAME

This is a continuation of application Ser. No. PCT/EP98/03680 filed on Jun. 18, 1998.

The invention relates to a regulating device for controlling the delivery flow in a motor-fuel injection pump, the regulating device being provided with a pump cylinder, a pump piston with inclined control edge and an adjusting sleeve, which embraces a piston foot of the pump piston while allowing free motion in axial direction, the piston foot being guided exactly in rotational direction by the adjusting sleeve.

Such regulating devices are known from the prior art for controlling the delivery flow of a motor-fuel injection pump, especially for diesel engines. They usually operate on the overflow principle with control by an inclined edge, thus permitting regulation of the delivery flow by turning the pump piston. The pump piston has a longitudinal groove, via which the pressure space above the piston is always in communication with the space disposed underneath an inclined edge (control edge). The useful stroke of the pump piston can therefore be changed by turning it. This is achieved by a regulating rod, which engages on the adjusting sleeve via a toothed ring. In this way the adjusting sleeve is firmly joined to the pump piston without influencing the stroke motion thereof. Control of the regulating-rod motion is then exerted either mechanically or electronically.

A practical example according to the prior art is shown in FIG. 9, wherein regulating rod 80 is provided with a toothing which engages in the outer toothing of adjusting sleeve 81. Under these conditions, adjusting sleeve 81 must permit axial motion of pump piston 82 in pump cylinder 83, but can turn this piston in circumferential direction.

The known regulating devices of the type explained in the foregoing require a complex manufacturing process and, during operation, tend to stick because the guide surfaces between adjusting sleeve and piston foot are in intimate contact; their frictional wear is correspondingly severe.

A regulating device with comparatively less tendency to sticking is described in Japanese Patent Application JP A 60132064. Therein, however, the inclination of the pump piston is variable because of relatively large play, since the inside diameter of the adjusting sleeve greatly exceeds the major diameter of the piston foot; only in the region of bottom dead center is the play in the said direction greatly reduced by a short crimp. In all other positions, on the other hand, considerable wear can be expected because of the large permissible inclination of the pump piston.

In contrast, the object of the present invention is to provide, for controlling the delivery flow of a motor-fuel injection pump, a regulating device of the type mentioned in the introduction which permits trouble-free and low-wear operation and can be manufactured inexpensively.

This object is achieved according to the body of claim 1.

By the fact that the piston foot is exactly guided by the adjusting sleeve in rotational direction regardless of stroke position, and by the fact that the adjusting sleeve embraces with its pump-side end a cylindrical portion of the pump cylinder while allowing axial displacement and rotational motion, it is guaranteed that the regulating device can be actuated without sticking.

In a further particularly advantageous embodiment of the invention, a regulating turning-lever plate is joined to the tubular profile at its end facing the pump cylinder, which plate intimately embraces the pump cylinder in circumferential direction in the manner of a partial circular arc.

According to the invention, it is provided in a regulating device of the present class that the adjusting sleeve has an elongated thin-walled tubular profile, preferably of deep-drawn sheet metal, a regulating turning-lever plate joined to the tubular profile, and a regulating turning lever on the regulating turning-lever plate. This permits inexpensive manufacture and low-wear and trouble-free operation.

An advantageous further design of the present invention provides that the regulating turning-lever plate is joined to the tubular profile at its end facing the pump cylinder. This can be achieved, for example, in that the tubular profile passes through the regulating turning-lever plate at two oppositely disposed circular portions and is braced against the regulating turning-lever plate at two further oppositely disposed circular portions.

It is also advantageous for the regulating turning-lever plate to embrace the pump cylinder in such a way that it is rotatable in circumferential direction relative to the pump cylinder. Hereby the adjusting sleeve is guided by the pump cylinder. For example, the two sides of the regulating turning-lever plate through which the tubular profile does not pass can be in close-fitting contact with the pump cylinder.

An advantageous embodiment of the present invention provides that line contact exists between piston foot and adjusting sleeve. This means that, by appropriate structural design of the tubular profile and of the piston foot, only contact points disposed along a line and not surfaces bearing over an area are formed. Only the piston foot is in contact with the adjusting sleeve. Thus maximum axial freedom of motion of the pump piston is assured while at the same time effective rotational capability thereof is achieved. Such features therefore work against tilting and wear.

Another advantageous embodiment provides that preferably only point contacts are formed between piston foot and adjusting sleeve. Hereby the friction between piston foot and adjusting sleeve is minimized and frictional wear is greatly reduced. In addition, the danger of sticking of the piston foot in the adjusting sleeve is minimized.

An advantageous further design of the invention provides that the adjusting sleeve has a tubular profile with crimps parallel to the longitudinal axis. This permits simple geometry of the piston foot and line contact thereof with the adjusting sleeve. In addition, the crimps permit relatively simple manufacture of the tubular profile and impart additional stiffness thereto. As an alternative to this embodiment, the adjusting sleeve can have a smooth tubular profile. This means that the adjusting sleeve, which has a cruciform or cloverleaf-shaped cross section, is provided, in contrast to the crimped tubular profile, with smooth walls, and the point or line contact is established by the shape of the piston foot.

Finally, an advantageous further design of the invention provides that the piston foot has convex structures protruding at the contact points. These convex structures resemble hemispheres attached to the piston foot. Such a piston-foot geometry can be manufactured by, for example, an erosion process. Such a structure in combination with a smooth tubular profile achieves point contact and thus minimum wear and reliable operation.

Another further design of the present invention provides that the tubular profile and regulating turning-lever plate are welded to one another. In this case, welding methods with low thermal distortion are particularly suitable. A small number of weld spots is sufficient for this purpose.

Yet another design of the present invention provides that the tubular profile and the regulating turning-lever plate are riveted to one another. This is advantageous for small production runs in particular and permits a nonpositive joint without thermal distortion.

Finally, it can be useful in a further embodiment of the invention for the tubular profile to have an antifriction coating. This can be, for example, a friction-reducing metal or plastic coating (such as Teflon), which is applied on the sheet metal of the tubular profile.

The present invention will be described in more detail hereinafter by means of practical examples with reference to the attached drawings, wherein.

Figure 1:
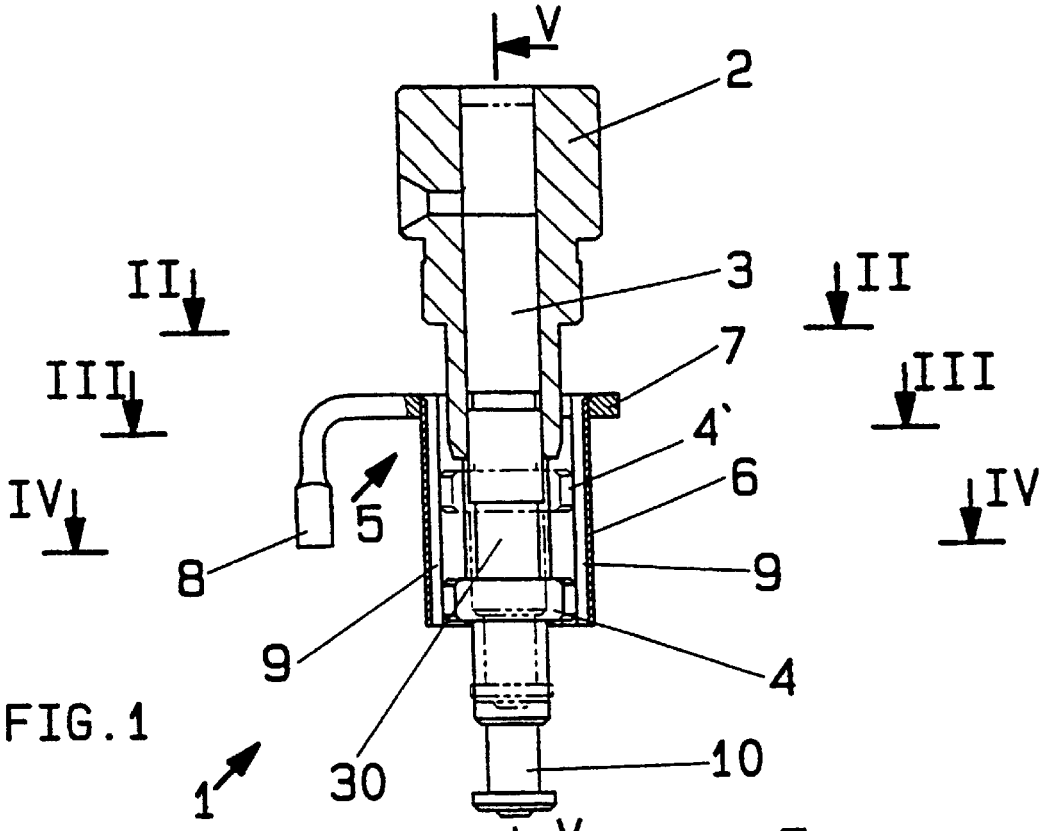
FIG. 1 shows a section through a regulating device according to the invention.

FIG. 1 shows, for a motor-fuel injection pump, an embodiment of regulating device 1 according to the present invention, which is provided with a pump cylinder 2, in which a pump piston 3 with groove and control edge, which are not illustrated, moves forward and back, as well as a piston foot 4 joined to pump piston 3 via piston rod 30, which foot can move freely in axial direction but is held captively in circumferential direction in an adjusting sleeve 5. Adjusting sleeve 5 is provided with a tubular profile 6, in which piston rod 30 can move forward and back freely in axial direction, and a regulating turning-lever plate 7, which is joined nonpositively to tubular profile 6. On regulating turning-lever plate 7 there is formed a hook-shaped regulating turning lever 8, the free end of which is provided with a bulb-shaped element. On regulating turning lever 8 there engages a regulating rod, not shown. Furthermore, crimps 9 are illustrated in tubular profile 6 of adjusting sleeve 5. By means of these crimps 9, piston foot 4 is guided in its axial longitudinal motion, as can be inferred from the dashed outline of piston foot 4'. The corresponding stroke motion of pump piston 3 is caused by an oscillating force applied to a pump tappet 10.

During operation, pump piston 3 moves forward and back in pump cylinder 2, whereby a corresponding fuel flow is delivered. Simultaneously, piston foot 4, 4' slides forward and back in the adjusting sleeve, line contact taking place along crimps 9. By corresponding positioning of the regulating rod, which is not shown, regulating turning lever 8 is turned, whereby adjusting sleeve 5 is turned relative to pump cylinder 2. Piston foot 4, 4' is also driven by the turning motion, whereby pump piston 3 turns in pump cylinder 2, thereby changing the position, relative to the fuel ports in the pump cylinder, of the control edge or longitudinal groove, which are not shown. Thus only turning in circumferential direction takes place between pump cylinder 2 and adjusting sleeve 5, whereas adjusting sleeve 5 and piston foot 4 move relative to each other in axial direction.

Figure 2:
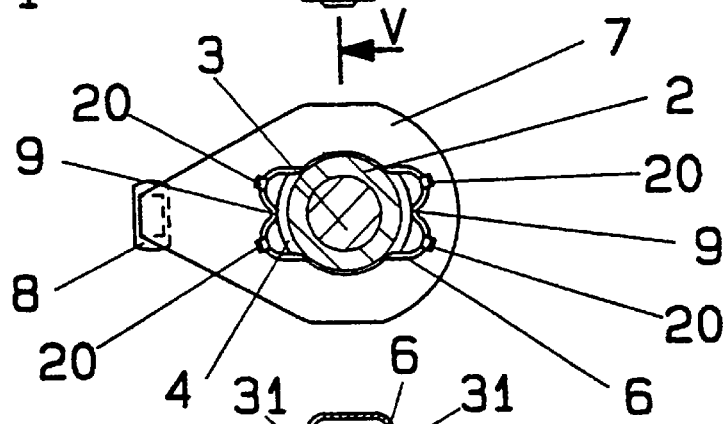
FIG. 2 shows a section along line II—II in FIG. 1.

FIG. 2 shows a section along line II—II in FIG. 1, and in this case pump cylinder 2, tubular profile 6, regulating turning-lever plate 7 as well as regulating turning lever 8 and pump piston 3 are illustrated. Regulating turning lever 8 is disposed in the manner of a hook perpendicular to regulating turning-lever plate 7, which forms a projecting arm tapering toward regulating turning lever 8. At the height of pump cylinder 2, the sides of the regulating turning-lever plate are flattened. At the end of pump cylinder 2 there is adjoined a convex structure of the regulating turning-lever plate shaped like a circular arc.

On the side of the pump cylinder facing regulating turning lever 8, and on the side opposite thereto, tubular profile 6 is passed through regulating turning-lever plate 7. In the region of the flattened sides, regulating turning-lever plate 7 bears against pump cylinder 2 in such a way that it permits rotational motion in the circumferential direction. On the whole, adjusting sleeve 5 embraces pump cylinder 2 in such a way that reliable guidance in circumferential direction is ensured without play. Furthermore, the places at which piston foot 4 is in contact with crimps 9 of tubular profile 6 can be seen. Tubular profile 6 is joined by rivets 20 to regulating turning-lever plate 7.

Figure 3:
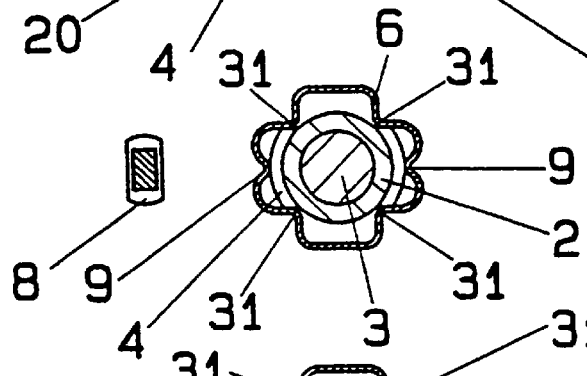
FIG. 3 shows a section along line III—III in FIG. 1.

FIG. 3 shows a section along line III—III in FIG. 1. The contour of tubular profile 6 of adjusting sleeve 5 is similar to a cloverleaf or a cross. Tubular profile 6 bears at its angled insides against pump cylinder 2, in which pump piston 3 moves forward and back in oscillating manner and is turned in circumferential direction to match the position of the regulating turning lever. Profiled sleeve 6 can be turned in circumferential direction around pump cylinder 2, while piston foot 4, which is in approximately line contact with tubular profile 6 both along crimps 9 and at angle corners 31 of tubular profile 6, is held captively in circumferential direction, thus accompanying the adjusting sleeve in its turning motion.

Figure 4:
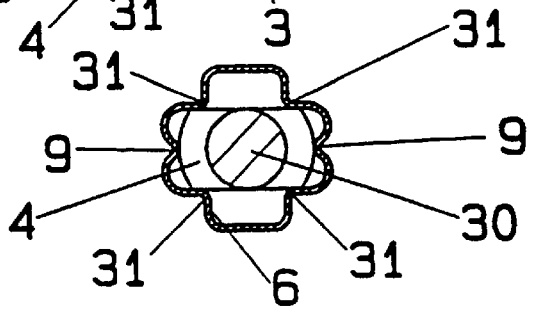
FIG. 4 shows a section along line IV—IV in FIG. 1.

FIG. 4 shows a section along line IV—IV in FIG. 1, in which piston foot 4 in tubular profile 6 is illustrated with crimps 9. Only piston foot 4 is in contact with tubular profile 6, in the form of imaginary lines. Piston rod 30 moves forward and back without play in adjusting sleeve 5. Piston foot 4 has substantially rectangular shape, except that the short side faces are arched in the form of portions of a cylinder. Line contact also exists for the most part at angle corners 31 of tubular profile 6.

Figure 5:
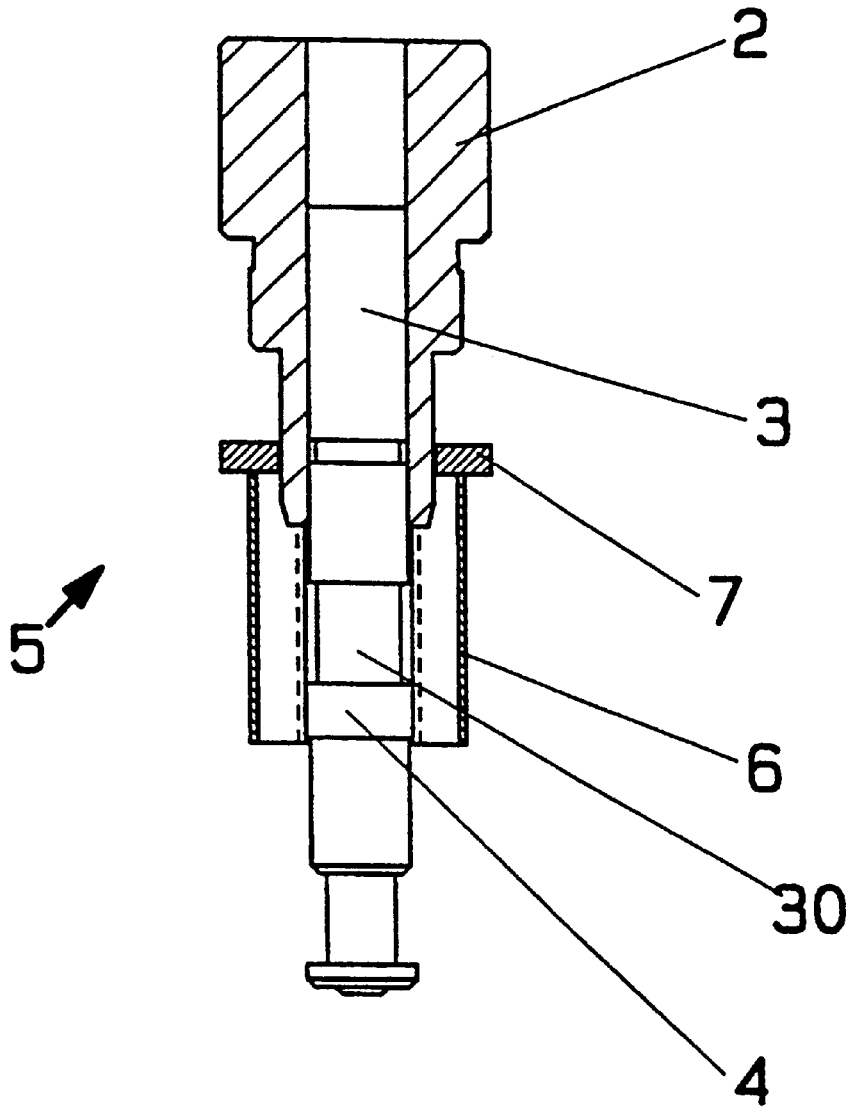
FIG. 5 shows a section along line V—V in FIG. 1.

FIG. 5 shows a section along line V—V in FIG. 1. Therein there are shown pump cylinder 2, pump piston 3, piston foot 4, adjusting sleeve 5 and tubular profile 6 as well as regulating turning-lever plate 7. It is evident here that the regulating turning-lever plate closely embraces pump piston 2 on two sides. Furthermore, the dashed lines indicate the cloverleaf shape of tubular profile 6, which bears against piston foot 4 to provide guidance, while piston rod 30 moves without play in adjusting sleeve 5.

Figure 6:
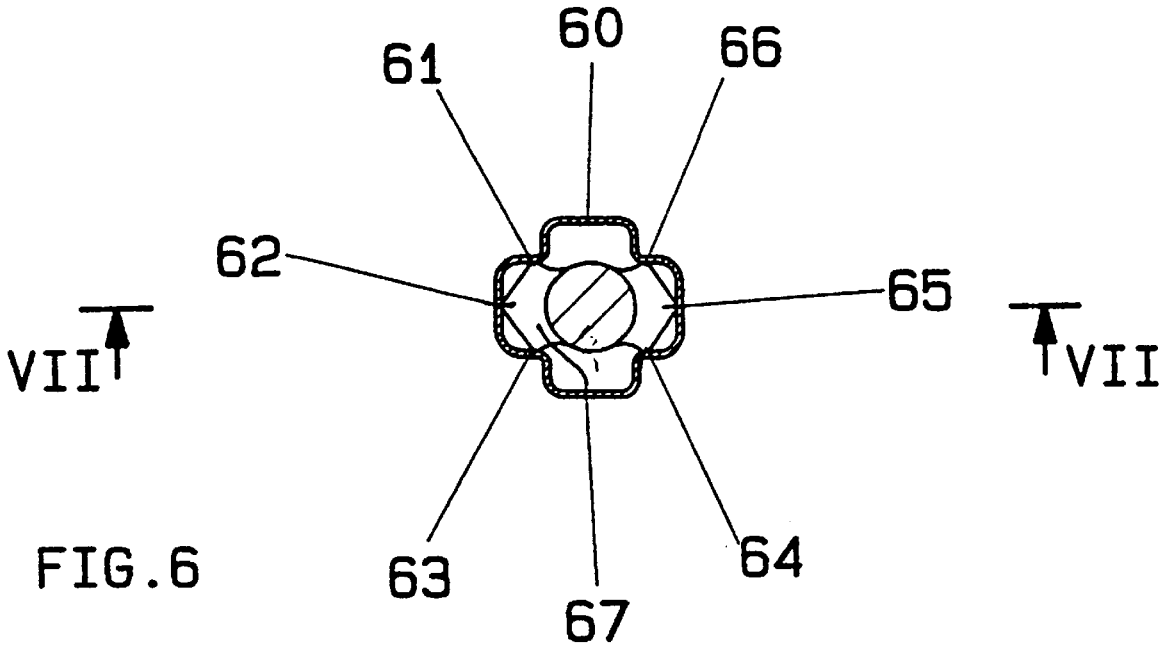
FIG. 6 shows a further embodiment in the section plane corresponding to FIG. 4.

FIG. 6 shows another embodiment of the present invention, the diagram corresponding in principle to that in FIG. 4. Cloverleaf-shaped tubular profile 60 is provided in this case with smooth walls, or in other words walls without crimps, and the corresponding point contact is produced by protruding convex hemispherical structures 61, 62, 63, 64, 65, 66 on piston foot 67.

Figure 7:
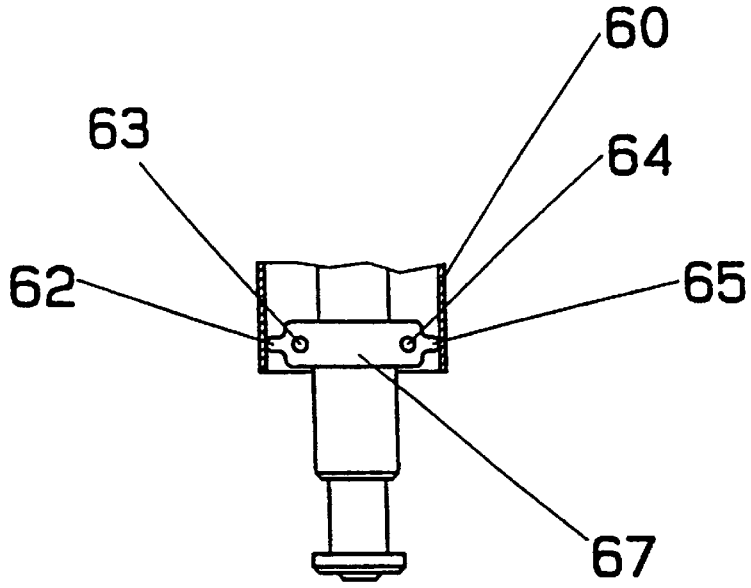
FIG. 7 shows a section along line VII—VII in FIG. 6.

FIG. 7 shows a section along line VII—VII in FIG. 6. Herein there are illustrated convex structures 62, 65 of piston foot 67 and the smooth, or in other words noncrimped wall of tubular profile 60.

Figure 8:
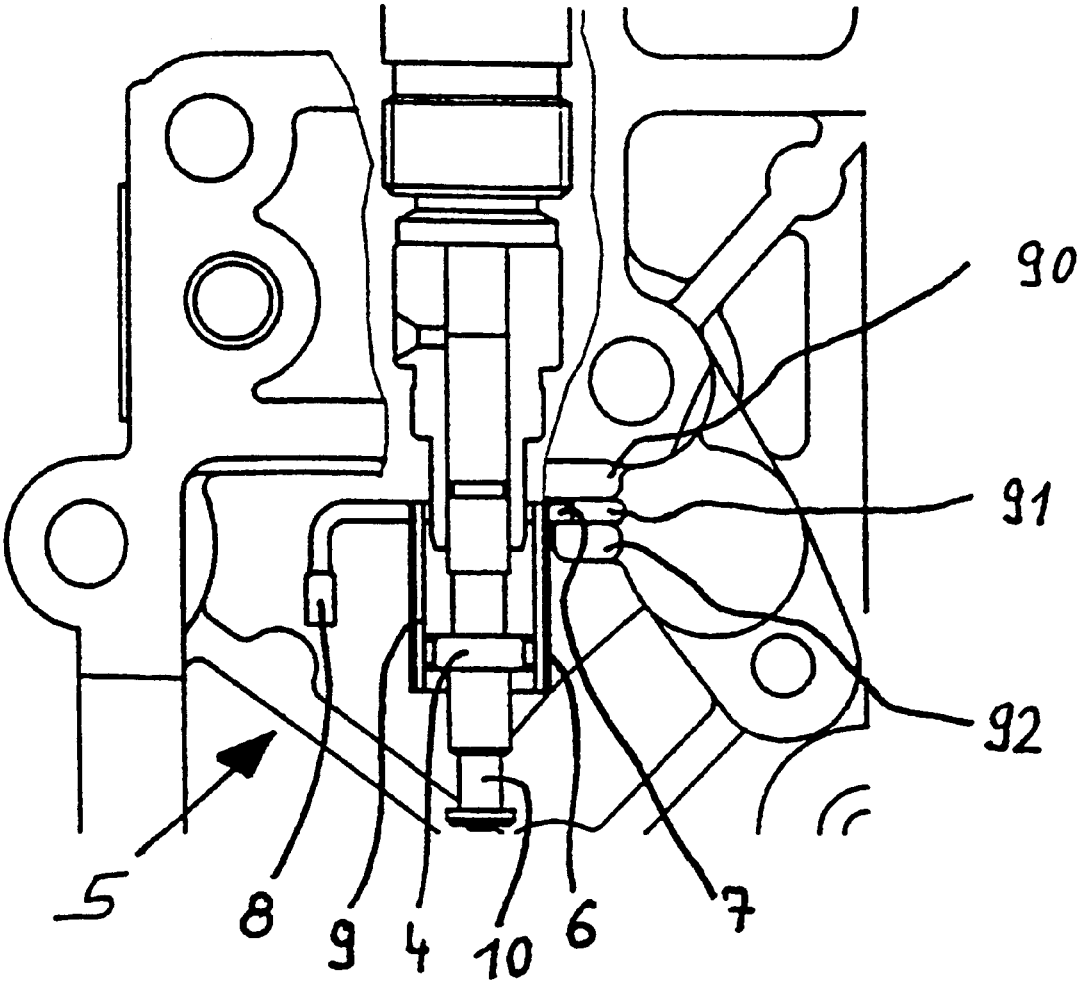
FIG. 8 shows a regulating device according to the invention in built-in condition.
Figure 9:
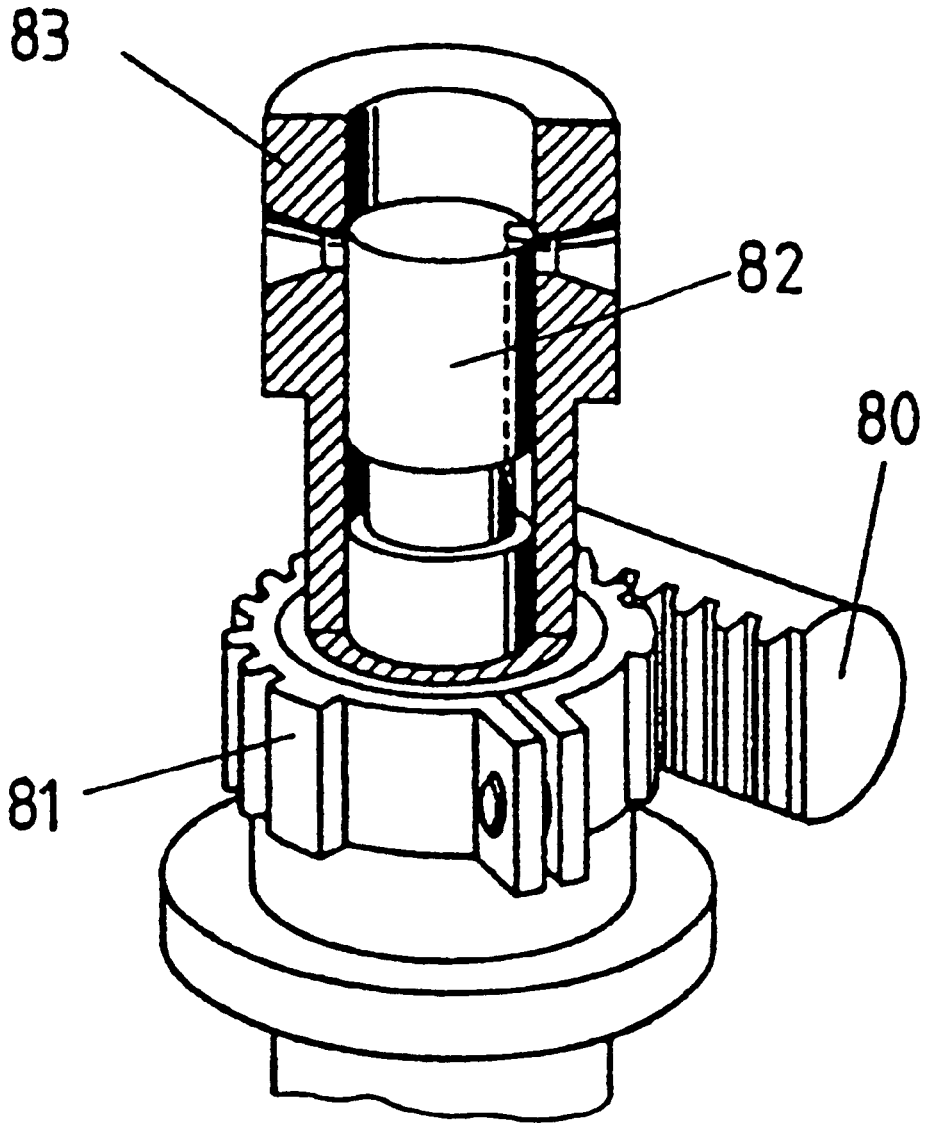
FIG. 9 shows a prior-art regulating device.

FIG. 8 shows the regulating device illustrated in the foregoing figures in its condition mounted on the engine block. Reference number 90 denotes the first rib of the engine block and 92 a second rib of the engine block. Reference number 91 defines the guide groove formed by the two ribs 90, 92. Adjusting sleeve 5 is secured against axial displacement by the engagement of the circular projection of regulating turning-lever plate 7 in a cast guide groove 91 of the engine block. In this case, groove 91 allows sufficient play that the adjusting sleeve can be turned in circumferential direction.

What is claimed is:

1. A regulating device for controlling the delivery flow in a motor-fuel injection pump, comprising:

a pump cylinder having a cylindrical portion, a pump piston disposed within the pump cylinder and having an inclined control edge and a piston foot, and an adjusting sleeve having a tubular profile which embraces and guides the piston foot in the rotational direction while allowing free motion of the piston foot in the axial direction, wherein the adjusting sleeve is formed with a constant cross section over its entire length and embraces the cylindrical portion of the pump cylinder while allowing axial displacement and rotational motion of said pump cylinder.

2. A regulating device according to claim 1, further comprising a regulating turning-lever plate joined to the adjusting sleeve at an end facing the pump cylinder, which plate intimately embraces the pump cylinder in the circumferential direction in the manner of a partial circular arc.

3. A regulating device according to claim 1, wherein the piston foot is adapted to make a plurality of line contacts with the adjusting sleeve.

4. A regulating device according to claim 1, wherein the piston foot is adapted to make a plurality of point contacts with the adjusting sleeve (5).

5. A regulating device according to claim 1, wherein the adjusting sleeve has a crimped tubular profile.

6. A regulating device according to claim 1, wherein the piston foot further comprises a plurality of protruding convex structures adapted to make point contact with the adjusting sleeve.

7. A regulating device according to claim 2, wherein the adjusting sleeve and regulating turning-lever plate are welded to one another.

8. A regulating device according to claim 2, wherein the adjusting sleeve and regulating turning-lever plate are riveted to one another.

9. A regulating device according to claim 1, wherein the adjusting sleeve further comprises an antifriction coating.

10. A regulating device in accordance with claim 1, wherein the adjusting sleeve has a cruciate tubular profile.

11. A regulating device for controlling the delivery flow in a motor-fuel injection pump, comprising:

a pump cylinder having a cylindrical portion, a pump piston movable within said pump cylinder, said pump piston having a piston foot, an adjusting sleeve having a constant cross-section along its length, said adjusting sleeve embracing the cylindrical portion of the pump cylinder while allowing for axial and rotational movement of said pump cylinder, and said adjusting sleeve embracing and guiding the piston foot in the rotational direction while allowing for axial movement of said piston foot, and a regulating turning-lever plate connected to the adjusting sleeve for rotation of the adjusting sleeve, said plate intimately embracing the pump cylinder in the circumferential direction.

* * * * *

UNITED STATES PATENT AND TRADEMARK OFFICE

CERTIFICATE OF CORRECTION

PATENT NO. : 6,196,198 B1
DATED : March 13, 2001
INVENTOR(S) : Guenter Kampichler It is certified that error appears in the above-identified patent and that said Letters Patent is hereby corrected as shown below:

Please correct the name of the Assignee from MOTOREFABRIK to MOTORENFABRIK.

Signed and Sealed this

Eleventh Day of September, 2001

*Attest:*

Nicholas P. Godici

NICHOLAS P. GODICI
*Acting Director of the United States Patent and Trademark Office*

*Attesting Officer*